US010595597B2

(12) United States Patent
Catheline et al.

(10) Patent No.: US 10,595,597 B2
(45) Date of Patent: Mar. 24, 2020

(54) ASSEMBLY SCREW FOR ASSEMBLING TWO HOROLOGY COMPONENTS

(71) Applicant: ROLEX SA, Geneva (CH)

(72) Inventors: Adrien Catheline, Valleiry (FR); James Rejzner, Saint-Julien-en-Genevois (FR)

(73) Assignee: ROLEX SA, Geneva (CH)

( * ) Notice: Subject to any disclaimer, the term of this patent is extended or adjusted under 35 U.S.C. 154(b) by 0 days.

(21) Appl. No.: 15/622,687

(22) Filed: Jun. 14, 2017

(65) Prior Publication Data

US 2017/0360163 A1 Dec. 21, 2017

(30) Foreign Application Priority Data

Jun. 15, 2016 (EP) ..... 16174609

(51) Int. Cl.

| | |
|---|---|
| ***A44C 5/02*** | (2006.01) |
| ***A44C 5/10*** | (2006.01) |
| ***G04B 31/00*** | (2006.01) |
| ***G04B 13/02*** | (2006.01) |
| ***G04B 37/14*** | (2006.01) |

(52) U.S. Cl.

CPC ..... *A44C 5/02* (2013.01); *A44C 5/107* (2013.01); *G04B 13/02* (2013.01); *G04B 31/00* (2013.01); *G04B 37/1486* (2013.01)

(58) Field of Classification Search

CPC ..... A44C 5/02; A44C 5/107; G04B 31/00; G04B 37/1486

See application file for complete search history.

(56) References Cited

U.S. PATENT DOCUMENTS 2,798,404 A * 7/1957 Schaefer ..... F16B 37/16 16/110.1
6,714,400 B2 * 3/2004 Guerry ..... A44C 5/14 361/282

(Continued)

FOREIGN PATENT DOCUMENTS

CH 695389 A5 4/2006
EP 0 165 206 A1 12/1985

(Continued)

OTHER PUBLICATIONS

European Search Report and Written Opinion dated Dec. 21, 2016 issued in counterpart application No. EP16174609; w/ English partial translation and partial machine translation (12 pages).

*Primary Examiner* — Edwin A. Leon
*Assistant Examiner* — Jason M Collins
(74) *Attorney, Agent, or Firm* — Westerman, Hattori, Daniels & Adrian, LLP

(57) ABSTRACT

Assembly screw (1) for the pivoting attachment of at least two horology components in a position of assembly, the assembly screw (1) comprising at least one guide portion (3) allowing one of the horology components to pivot, and at least one threaded portion (4) allowing it to be fixed to another horology component, wherein this screw comprises a shoulder (5) intended to come into abutment against this other horology component and a zone (10) of lower mechanical rigidity to reduce the contact pressure applied at the shoulder (5) of the assembly screw when the horology components are in the position of assembly.

24 Claims, 2 Drawing Sheets

(56) References Cited

U.S. PATENT DOCUMENTS

| | | | | |
|---|---|---|---|---|
| 2008/0267017 | A1* | 10/2008 | Fuwausa ..... | G04B 37/0008<br>368/286 |
| 2012/0069720 | A1 | 3/2012 | Catheline et al. | |
| 2012/0144862 | A1 | 6/2012 | Catheline | |

FOREIGN PATENT DOCUMENTS

| | | | |
|---|---|---|---|
| EP | 2 462 829 | A1 | 6/2012 |
| JP | H03-7712 | U | 1/1991 |
| JP | 2005-124770 | A | 5/2005 |

* cited by examiner

ASSEMBLY SCREW FOR ASSEMBLING TWO HOROLOGY COMPONENTS

FIELD OF THE INVENTION

This application claims priority of European patent application No. EP16174609.4 filed Jun. 15, 2016, the content of which is hereby incorporated by reference herein in its entirety.

BACKGROUND ART

The invention relates to an assembly or attachment screw for the pivoting assembly or attachment of at least two horology components, notably two links of a bracelet, for example a watch bracelet. It also relates to a bracelet and, more generally, to a timepiece, such as a wrist watch, both per se, comprising at least one such assembly screw for the pivoting assembly of at least two of their components.

It is known practice to assemble two links of a watch bracelet using a pivoting-guidance pin supported by a screw, the assembled links being able to move rotationally relative to one another. An assembly of this type is exposed to a risk of unwanted unscrewing. This problem, well known to watchmakers, is caused by the repeated movements of the links relative to one another while the bracelet is being worn, or by shoks.

A first solution from the prior art is to use an adhesive, generally referred to as "thread lock", placed on the threads of an assembly screw in order to reduce the risk of unwanted unscrewing. Such a solution is tricky in practice because it is necessary to master the correct quantity of adhesive. It also demands specialist tooling and a corresponding assembly time. Aftersales service operations are also complex.

Document CH695389 proposes another solution. It describes a device for the pivoting assembly of links of a watch bracelet. This assembly device comprises a screw provided with a head, at one of its ends, and with a threaded part, at its other end. A central part of the screw, cylindrical in shape, acts as a guide pin for the rotational guidance of the central link element. In order to limit the risk of unwanted unscrewing, a tubular cannon made of an elastic material and provided with an annular narrowing is driven into a passage hole in one of the outer link elements, through which passage hole the screw passes, and collaborates with a predetermined portion of the screw. Upon assembly, the screw is introduced into the cannon until the cannon and the screw engage. In the final tightened position, the cannon applies a radial clamping force to the screw which combines with the retention force exerted by the threads of the screw. The screw is thus axially immobilized with respect to the link. Such a solution entails the assembly of several components, which requires a relatively lengthy assembly time. Furthermore, because the clamping force applied by the cannon to the screw has to be high, assembly and/or disassembly operations prove to be difficult.

SUMMARY OF THE INVENTION

It is an object of the present invention to propose an improved solution for the pivoting assembly of two horology components, which does not have all or some of the disadvantages of the prior art.

More specifically, one object of the invention is to propose a simpler and more reliable solution for the pivoting assembly of two horology components.

To that end, the invention hinges on an assembly screw for the pivoting attachment of at least two horology components in a position of assembly, the assembly screw comprising at least one guide portion allowing one of the horology components to pivot, and at least one threaded portion allowing it to be fixed to another horology component, wherein this screw comprises a shoulder intended to come into abutment against this other horology component and a zone of lower mechanical rigidity to reduce the contact pressure applied at the shoulder of the assembly screw when the horology components are in the position of assembly.

For preference, the assembly screw has a shoulder of enlarged surface area, greater than or equal to 0.8 $mm^2$, or even greater than or equal to 0.9 $mm^2$, or even greater than or equal to 1 $mm^2$.

In addition, the threaded portion of the assembly screw is preferably small in size and has an outside or nominal diameter less than or equal to 2 mm.

The invention is more precisely defined by the claims.

BRIEF DESCRIPTION OF THE DRAWINGS

These objects, features and advantages of the present invention will be explained in detail in the following description of one particular embodiment given by way of nonlimiting example in conjunction with the attached figures among which.

DETAILED DESCRIPTION OF PARTICULAR EMBODIMENTS

The invention relates to an assembly or articulation screw intended to assemble at least two horology components able to pivot relative to one another. It may notably be used for assembling links, for example links of a bracelet such as a wristwatch bracelet.

Thus, one embodiment will be described nonlimitingly hereinbelow in the context of the assembly of links of a watch bracelet. By convention, the direction parallel to the axis of the assembly screw will be referred to as the longitudinal direction and the perpendicular direction will be referred to as the transverse direction. In addition, the assembly screw will be considered in the direction in which it is introduced, its first end being opposite to its second end comprising its head, and the term upstream denoting a part oriented toward the side of this second end.

Figure 1:
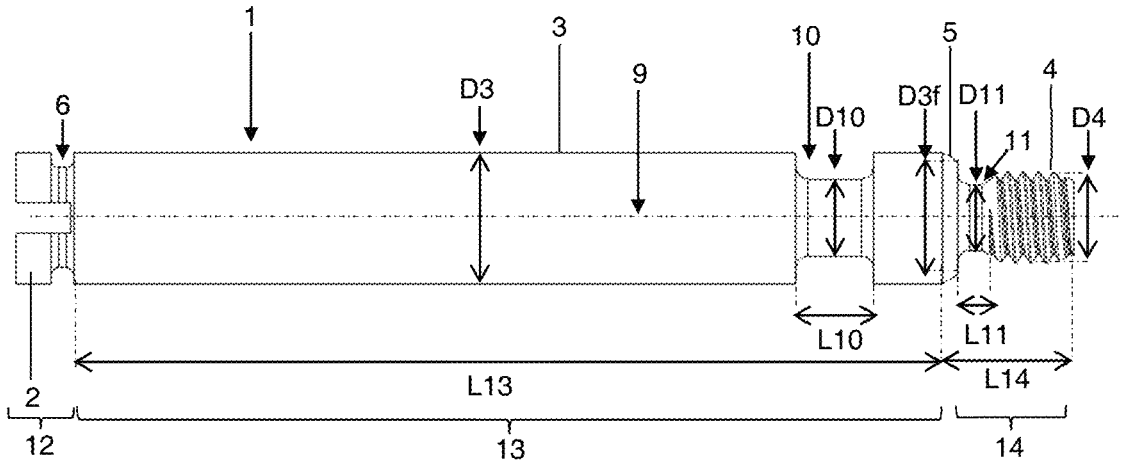
FIG. 1 depicts an assembly screw according to one embodiment of the invention.

FIG. 1 depicts an assembly screw 1 according to one embodiment of the invention. This screw is arranged around a longitudinal axis 9, which forms an axis of rotation when the screw is actuated. The screw comprises a first end comprising a threaded portion 4, of outside (nominal) diameter D4. It additionally comprises a guide portion 3, in the central part, of cylindrical shape, of diameter D3, the exterior surface of which forms a surface for guiding the pivoting of a link, as will be explained in detail hereinafter.

The screw then comprises a head 2 designed to be actuated using a tool, such as a screwdriver, at its second end.

The assembly screw 1 additionally comprises at least one first zone 10 of lower mechanical rigidity. This zone is arranged within the guide portion 3. It is advantageously positioned near the threaded portion 4. For that, its downstream end is preferably positioned at a distance L100, measured from the downstream end of the shoulder 5, that is less than or equal to the length L13/3, or even less than or equal to L13/5, or even less than or equal to L13/6. In the embodiment, the distance L100 is of the order of 1 mm. This first zone 10 of lower mechanical rigidity is preferably situated in the half of the screw that is positioned on the side of its first end, comprising the threaded portion 4. According to the embodiment proposed, it takes the form of a groove, of minimum diameter D10 and with width in the longitudinal direction. For preference, neck-mouldings are created at the bottom of the groove and are sized, notably maximized, according to the format of the screw in order to avoid concentration of stresses. As an alternative, the zone 10 of lower mechanical rigidity can be formed by any other geometry. It may thus for example be a groove of constant or non-constant diameter. This zone may be obtained by any removal of material within the guide portion 3 of the screw or by any other equivalent manufacturing process. The hollow space obtained, for example formed by this removal of material, creates an empty space. This hollow space preferably observes the symmetry of revolution about the longitudinal axis 9 of the assembly screw 1. The geometry of this hollow space arranged in the surface of the assembly screw is sufficient to induce a significant drop in the mechanical rigidity of the assembly screw. Thus, this is not a simple small groove that would form an abutment surface or fulfill some other function, but a groove intended to locally minimize the flexural inertia of the body of the screw. Thus, this hollow space is such that the ratio D10/D3 is comprised between 0.1 and 0.9 inclusive, or even between 0.3 and 0.7. Since this zone 10 of lower mechanical rigidity may have any shape whatsoever, its cross section, which is preferably substantially circular in order to maintain axial symmetry, could potentially be not circular but for example hexagonal. In that case, its minimum cross section would be inscribed inside a circle of diameter D10 such that the ratio D10/D3 is comprised between 0.1 and 0.9 inclusive, or even between 0.3 and 0.7 inclusive. In addition, the width L10 of this zone 10 of lower mechanical rigidity is likewise great so as to better distribute stresses. In particular, the ratio L10/L13 is preferably comprised between 0.04 and 0.3 inclusive, where L13 is the length of the central part 13 of the assembly screw 1, which will be detailed hereinafter. In the embodiment, the width L10 is of the order of 1 mm. The zone of lower mechanical rigidity is preferably delimited by neck-mouldings having a radius of the order of 0.5 mm or greater than 0.5 mm. As an alternative, the zone 10 of lower mechanical rigidity may be positioned outside of the guide portion 3, in the central part 13 or elsewhere. Finally, the assembly screw preferably has a small size and in particular its threaded portion advantageously has an outside or nominal diameter less than or equal to 2 mm.

Figure 2:
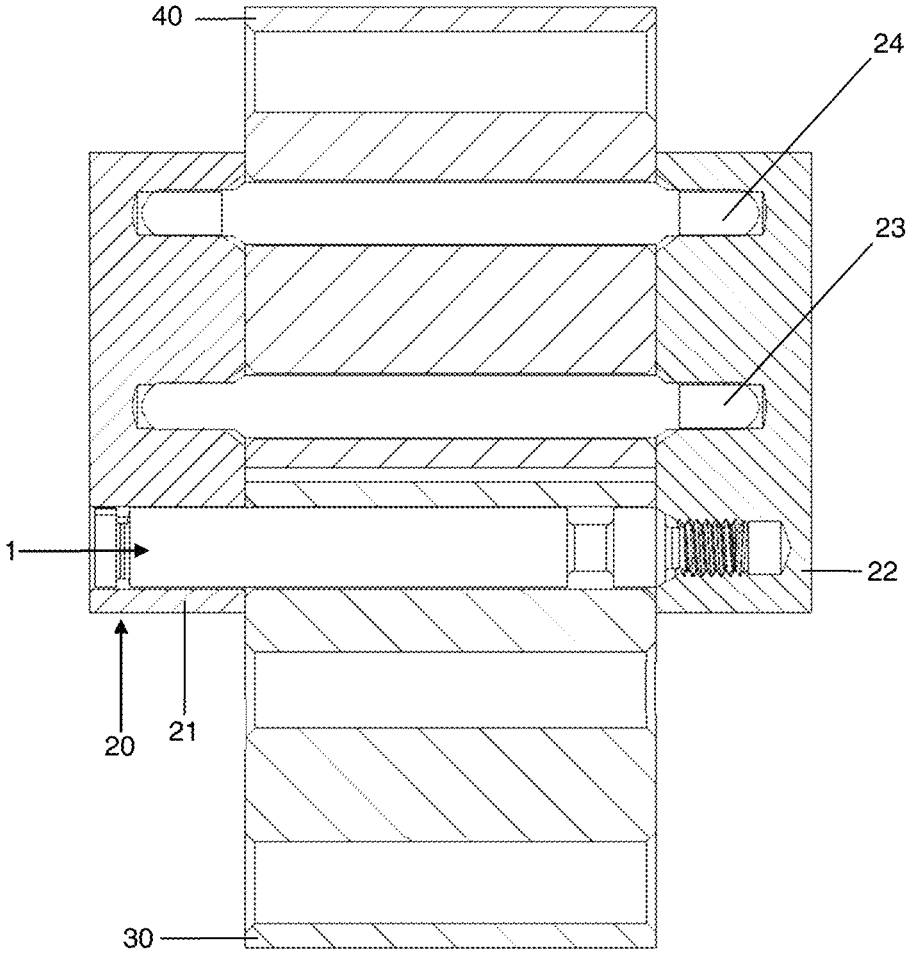
FIG. 2 depicts two bracelet links assembled with pivoting using an assembly screw according to the embodiment of the invention.
Figure 3:
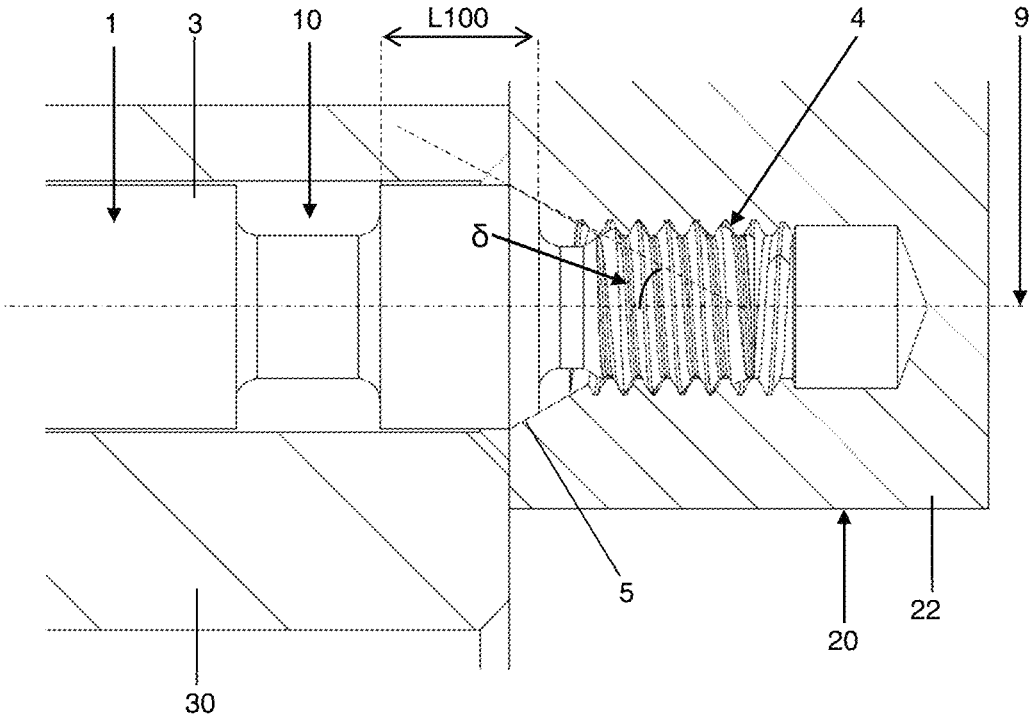
FIG. 3 depicts an enlarged view of the two bracelet links of FIG. 2 to show details of the assembly according to the embodiment of the invention.

Finally, the assembly screw 1 comprises a shoulder 5 intended to come into abutment with a corresponding abutment surface of one of the links that are to be assembled, as is illustrated in FIGS. 2 and 3. In this embodiment, this shoulder 5 has a frustoconical shape extending between the end of the guide portion 3, of diameter D3, and a zone of reduced diameter D3*f*. This frustoconical surface is finally obtained by a chamfer starting at the end of the guide portion 3 of the assembly screw 1, which chamfer exhibits an angle δ with respect to the longitudinal axis 9 of the assembly screw, particularly illustrated in FIG. 3. This angle δ may be chosen on the basis of a predefined industrial process, particularly with regard to an optimal method of manufacturing a tapped hole in the first link, as will be described hereinbelow. In the embodiment depicted in the figures, the angle δ is equal to approximately 30°. More generally, this angle may be comprised between 10° and 60° inclusive, or even between 20° and 45° inclusive.

According to the embodiment, the assembly screw 1 may finally be considered as comprising three parts. These will be considered hereinafter in the order in which they are introduced into the openings in the horology components in order to assemble same:

- an initial part 14, of length L14, comprising the shoulder 5 followed by the threaded portion 4. Thus, this initial part 14 is partially threaded. A second zone 11 of lower mechanical rigidity is positioned between these two elements 4, 5. This zone takes the form of a second groove of minimal diameter D11 and of width L11 in the longitudinal direction. This second zone 11 of lower mechanical rigidity may exhibit geometric variations, in a similar way to the first zone described hereinabove. Thus, its diameter D11 may be constant or non-constant. Such a configuration also makes it possible to encourage the elongation or compression of the initial part 14 of the assembly screw 1 according to the prescriptions required in order to obtain an adequate tightening torque suited to the desired retention performance. For preference, neck-mouldings are created at the bottom of the groove and are maximized according to the format of the assembly screw so as to avoid concentrations of stresses. The second zone 11 of lower mechanical rigidity is therefore made in the region of the initial part 14 of the assembly screw, and therefore downstream (in the direction of introduction of the screw) of the shoulder 5 and in the immediate vicinity upstream of the threaded portion 4. According to the embodiment, this second zone 11 of lower mechanical rigidity may have a geometry characterized by the following expressions: $0.5 \leq D11/D4 \leq 0.9$ and $0.1 \leq L11/L14 \leq 0.6$;
- a central part 13, of length L13, comprising the guide portion 3, which itself incorporates the first zone 10 of lower mechanical rigidity. It adopts a continuous cylindrical shape, of a diameter D3 that is constant, apart from the zone 10 of lower mechanical rigidity, provided toward its end near the initial part 14;
- a final part 12, comprising the head 2, optionally preceded by a groove 6 designed to accept a screw extraction tool and thus allow quick and easy disassembly, notably during in-store operations or during aftersales service.

FIGS. 2 and 3 more particularly depict the assembly screw 1 according to the embodiment, described previously, in the context of the assembly of two links 20, 30 of a bracelet. The first link 20 notably comprises two edge link elements 21, 22 which are joined together in a known way by assembly means 23, 24. These same assembly means 23, 24 secure a third link element 40 within the first link 20. The second link 30 in FIG. 2 takes the form of a single center link element. Naturally, identical assembly screws can be used to fix more than two links of the same bracelet, preferably bracelet extension links. The links may take the form of one or more link elements.

In the position of assembly of the two links 20, 30 as depicted in FIGS. 2 and 3, the first end of the assembly screw 1 is lodged in an opening of the second link element 22 of the first link 20 and its second end comprising the head 2 is lodged within an open-ended opening of the first link element 21 of the first link 20. The threaded portion 4 of the screw thus collaborates with a corresponding threaded portion of the second link element 22 of the first link 20, which has a tapped hole. The assembly screw 1 is additionally positioned within an through-opening of the second link 30. The respective openings of the two links 20, 30 are thus aligned and have the assembly screw 1 passing fully or partially through them. The initial part 14 of the assembly screw 1 is completely integrated into the second link element 22 of the first link 20. The final part 12 and a portion of the central part 13, of short length, are positioned in the opening of the first link element 21 of the first link 20. The rest of the central part 13, including the zone 10 of lower mechanical rigidity, is positioned within the opening of the second link 30, and performs the function of guiding the rotation of this second link 30. The shoulder 5 of the assembly screw is positioned in abutment at the entrance to the opening of the second link element 22, which opening has a truncated part forming an abutment surface of a geometry that corresponds to that of the shoulder 5 and preferably covering the entirety of the shoulder 5 (same angle, and preferably at least the same surface).

In this position of assembly, the central link 30 is thus held axially between the two edge link elements 21, 22 and is mobile in pivoting, with a small amount of clearance, about the guide portion 3 of the assembly screw 1 and therefore about an axis of rotation corresponding to the longitudinal axis 9 of the assembly screw 1.

In practice, assembling two links with such an assembly screw is performed by screwing the assembly screw until a tightness is reached that is defined by a predetermined torque on the screw. A suitable pretension is thus applied to the screw in order to guarantee a lasting assembly, notably to avoid the unwanted "loosening" of the assembly screw, something which occurs when the screw head rotates by a small amount leading to a large fall in torque at the screw. Note that once the screw is loosened, it can also become unscrewed inadvertently, which means to say can continue to turn, then inducing only a small fall in torque at the screw. The unwanted loosening of the screw may thus lead to the unwanted unscrewing thereof and, in the worst event, lead to loss of the screw from the bracelet and cause the bracelet or the wristwatch to fall off.

In a known way, the pretension in the screw is induced during tightening by an elastic deformation of the body of the screw, particularly the threaded portion 4 thereof, when the screw is in abutment against one of the components that are to be assembled, in this embodiment the second link element 22. This pretension force in the screw is optimized to guarantee a lasting assembly, as explained hereinabove.

According to the invention, it has been discovered that optimization is advantageously achieved by providing a fixed abutment for the screw. What we mean by a "fixed abutment" is any abutment defined by nondeformable surfaces in contact, which means to say surfaces in contact which cannot suffer from peening. Specifically, studies by the applicant company have demonstrated that the reduction in the tightening torque of the screw can notably be explained by a loss in the elastic potential energy brought about by plastic deformation during phases of loading of the threaded portion of the screw. Thus, the assembly screw according to the embodiment preferably applies implementation of contact surfaces which cannot suffer from peening for a given tightening torque and/or during loadings of the bracelet when the watch is being worn, notably during tensile stresses or torsion loadings of the strand of bracelet involved in the assembly.

For that, the assembly screw according to the embodiment has a first zone 10 of lower mechanical rigidity, described hereinabove. This zone performs the function of absorbing external stress loadings, notably shocks, through the effects of flexing of the screw. It allows the threaded portion 4 to be isolated from external stress loadings. Such a configuration thus makes it possible to minimize contact pressures at the shoulder 5 where the screw and the corresponding abutment surface of the second link element 22 of the first link 20 bear against one another. Such a solution thus makes it possible to define a "fixed abutment" between the assembly screw 1 and the first link 20. It notably makes it possible to obtain contact pressures at the respective abutment surfaces which are lower than the admissible stresses of the materials involved in the assembly, for example lower than the admissible stresses of the gold alloys commonly used for bracelet links.

For preference, the zone 10 of lower mechanical rigidity is set back from the interfaces of the links 20, 30 so as to isolate it from shear effects, particularly when the bracelet is loaded in tension or in torsion. Thus, the zone 10 of lower mechanical rigidity can be positioned within the bore of the second link 30. This zone is thus positioned within the guide portion 3 of the assembly screw 1. Its location is, however, defined as being as close as possible to the threaded portion 4 so as to best isolate this threaded portion from external stresses. As an alternative, it could therefore be situated within the tapped hole of the second link element 22, if the latter is of sufficient length, for example as a replacement for the second zone 11 of lower mechanical rigidity of the embodiment depicted.

Furthermore, plastic deformation at the abutment surface for the assembly screw may thus be induced by an insufficient interface between the assembly screw and the surface via which it abuts on the link, for a given tightening torque, for example on account of the small horology dimensions and the lack of volume available within horology assemblies.

According to the embodiment, this interface corresponds to the area A of the shoulder 5 of the assembly screw 1, in area contact with the corresponding abutment-forming surface of the second link element 22. This area A is therefore preferably maximized. According to the embodiment of the invention, the area A, of truncated shape of angle δ, can be calculated using the following formula:

$$A = \frac{\pi(D3 + D3f)}{2}\sqrt{\left(\frac{D3 - D3f}{2}\right)^2 + \left(\frac{D3 - D3f}{2\tan\delta}\right)^2}$$

In the horology application envisaged by the embodiment of the invention, in the region of the assembly of the links of a bracelet, the area A is advantageously greater than 0.8 $mm^2$, or even 0.9 $mm^2$ or even 1 $mm^2$ for an outside or nominal diameter D4 of the threaded portion 4 less than or equal to 2 mm. Such a configuration which maximizes the shoulder area at the abutment of the assembly screw advantageously makes it possible to reduce the contact pressures at this abutment and thus contributes to obtaining the technical effect desired by the invention. This increase in the area of the shoulder thus on its own affords an improvement, over the existing solutions of the prior art, as will be illustrated in relation to FIG. 4. However, it is advantageously combined with the implementation of a zone 10 of lower mechanical rigidity, as defined hereinabove.

The assembly screw 1 described hereinabove thus makes it possible to make a pivoting assembly of two horology components more reliable by preventing or reducing the risk of unwanted untightening thereof.

Naturally, the invention is not restricted to the precise geometry described in the preceding embodiment. Thus, for preference, the shoulder 5 is situated upstream of the threaded portion 4 in such a way as to generate traction on said portion 4 during the tightening of the screw in abutment against the abutment surface of the first link 20, as depicted. Alternatively, the shoulder 5 may also be situated downstream of the threaded portion 4, so that the assembly screw 1 constitutes a "binding" screw. Such a configuration then makes it possible to generate compression on the initial portion comprising the threaded portion 4. Such a solution could prove particularly advantageous, notably with regard to its performance during bending stress loadings, which have a tendency to compress said portion still further and thus further accentuate the pretension in the screw.

In addition, the shoulder 5 adjoins the threaded portion 4 in the embodiment. Advantageously, the abutment for the screw is obtained as an abutment surface of a link in the form of a chamfer, preferably at the entrance to a tapped hole in the second link element 22, so as to bring the shoulder 5 and the partially threaded portion 4 as close together as possible.

However, as an alternative, the shoulder 5 may adjoin the head 2 of the assembly screw 1. In such a scenario, the shoulder 5 may define abutment under the head which abutment is intended to collaborate with a surface of the first link element 21, returning to the application depicted in FIGS. 2 and 3, for example in the form of a chamfer at the entrance to the bore of the first link element 21 allowing the body of the screw to pass.

Advantageously, the guide portion 3 of the body of the assembly screw 1, which portion is intended to guide the pivoting with small clearance of the second link 30, is configured to minimize friction between the screw and the pivoting link and thus minimize the stress loadings on the screw under the effect of the movement of said link, particularly the effects of sliding of the link when loaded in tension. To that end, the guide portion 3 may be covered with a surface coating or undergo a treatment with a view to minimizing the coefficient of friction between the screw and the link. In particular, the surface of the guide portion 3 may be hardened using any process, for example a hardening obtained by a process known by its tradename of Kolsterizing, or from a "hard" coating from among CrN, TiAlN, or HfN. As an alternative, a coating qualified as "soft" (also referred to as solid lubricant) may be employed, for example using a material known by its tradename of Nuflon® GBT5. As an alternative, a coating of viscous lubricant type (oil or grease) may be implemented. Alternatively or in addition, such a hardening or coating may be applied to the bore of the link guided by this guide portion. In addition, this coating or hardening may extend beyond the guide portion 3, notably onto the entire central part 13 of the assembly screw 1.

Advantageously, the threaded portion 4 of the assembly screw 1 may be provided with an end screw thread so as to maximize the number of threads engaged and thus optimize the tension applied in the body of the screw for a given tightening torque. Furthermore, this threaded portion 4 may be adapted to allow the use of a thread lock, particularly a dry thread lock.

Such a screw geometry may moreover be particularly suited to small diameters of screw, for example to screws with a nominal thread diameter less than or equal to 2 mm, making such an assembly screw particularly well suited to horology applications.

Figure 4:
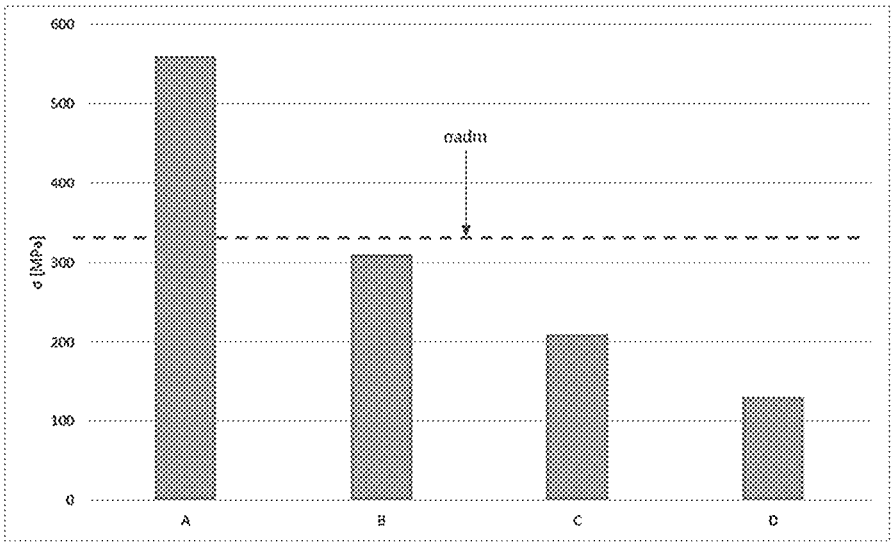
FIG. 4 depicts a number of pressure calculations for assemblies of bracelet links respectively using different assembly screws in order to illustrate the effect of the invention.

FIG. 4 depicts a diagram comparing contact pressures at the abutment surfaces of an assembly screw and of the second link element of a bracelet link, in a configuration as depicted by FIG. 2, for four different assembly screws A, B, C, D respectively. Thus, in all these instances, the abutment surface is defined by a truncated shoulder situated upstream of a threaded or partially threaded portion of the assembly screw, this abutment surface or shoulder thus generating tension in the threaded portion when the screw in abutment against the corresponding truncated abutment surface of the link element is tightened. All the assembly screws A, B, C, D have roughly similar dimensions, notably the same guide-portion diameter of 1.7 mm, and the same screw thread diameter. Furthermore, all these assembly screws are made of gold, as are the link elements of the bracelet. The tightening torque of the assembly screw, which is identical in each of the cases, is 5 Ncm. The contact pressures $\sigma$, indicated on the ordinate axis of the diagram, are calculated for a conventional wearing of a wristwatch comprising the bracelet incorporating said assembly screws. The admissible stress $\sigma adm$ at the contact is also indicated by the dashed line.

The four assembly screws A, B, C, D tested are indicated on the abscissa axis. They differ from one another in terms of the following specific features:

- assembly screw A constitutes a screw representative of the prior art, which means to say that it does not comprise a zone of lower mechanical rigidity and has a shoulder with a surface area equal to 0.75 $mm^2$;
- assembly screw B does not have a zone of lower mechanical rigidity and is similar to assembly screw A, but has an increased area of shoulder, of the order of 1 $mm^2$;
- assembly screw C, according to an embodiment of the invention, is similar to assembly screw A but comprises a zone of lower mechanical rigidity, characterized by a geometry D10/D3≈0.6 and L10/L13≈0.09. It has a shoulder area equal to 0.75 $mm^2$, like assembly screw A;
- assembly screw D, according to another embodiment of the invention, combines the zone of lower mechanical rigidity of assembly screw C, with a shoulder of increased surface area, of the order of 1 $mm^2$.

Thus it may be noted that the presence of the zone of lower mechanical rigidity, which is present on assembly screws C and D, affords a significant technical effect because it makes it possible to reduce the contact pressures significantly. Combining it with a shoulder of increased surface area, on assembly screw D, makes it possible to reduce the contact pressures by a factor of the order of 4 in comparison with assembly screw A of the prior art. This then is the best-performing solution tested. Note in addition that the mere increase in the area of contact (assembly screw B) also affords an improvement over the solution of the prior art (assembly screw A).

In all of the embodiments described hereinabove, the assembly screw finally comprises at least one zone of lower mechanical rigidity, as defined hereinabove, which reduces the contact pressures of the assembly screw at its abutment and thus increases its reliability by greatly reducing the risk of it becoming untightened. The invention is not restricted to the embodiment described and this zone could be positioned differently on the length of the screw, upstream or downstream of the threaded portion, a greater or lesser distance away from this threaded portion, but preferably close by. As an alternative, there could be several complementary zones of lower mechanical rigidity, at least two as in the embodiment depicted in FIG. 1, or even three or more.

Furthermore, the geometry of the assembly screw is preferably also designed to increase the area of its shoulder, as described hereinabove.

The assembly screw is preferably made from a metallic material such as gold, platinum, titanium, steel, such as steel 316L or 904L or P558, or cobalt-based alloys such as Phynox and Nivaflex. Naturally, other, non-metallic materials such as ceramic or composites may also be used to create such screws. Of course, this list of materials is not in any way limiting. In addition, the screw is preferably in a single piece, of one-piece construction. As an alternative, this assembly screw may comprise several distinct elements assembled with one another.

The assembly screw of the invention is advantageously used for an implementation in assembling links of a bracelet, as has been described. Thus, the invention also relates to a bracelet per se, for which all or some of the links, which may have any geometry not restricted to the example depicted in FIGS. 2 and 3, are assembled with the aid of such assembly screws. It also relates to a wristwatch per se, comprising such a bracelet. In addition, the invention is not restricted to a use of such an assembly screw for a bracelet, but also covers its use in the pivoting assembly of any two horology components of a timepiece.

The invention claimed is:

1. An assembly screw for the pivoting attachment of at least two horology components in a position of assembly, the assembly screw comprising:

at least one guide portion allowing a first one of the horology components to pivot, and at least one threaded portion allowing the first one of the horology components to be fixed to another horology component, a shoulder intended to come into abutment against the other horology component, the shoulder being located between the guide portion and the threaded portion, a first zone of lower mechanical rigidity to reduce the contact pressure applied at the shoulder of the assembly screw when the horology components are in the position of assembly, the first zone of lower mechanical rigidity being located within the guide portion, and a second zone of lower mechanical rigidity located between the shoulder and the threaded portion, wherein the first zone of lower mechanical rigidity has a minimum cross section inscribed inside a circle of diameter D10 so that the ratio D10/D3 is comprised between 0.1 and 0.9 inclusive, where D3 is the diameter of the adjacent guide portion.

2. The assembly screw as claimed in claim 1, wherein the shoulder has a surface area greater than or equal to 0.8 $mm^2$.

3. The assembly screw as claimed in claim 1, wherein the screw has a width L10 so that the ratio L10/L13 is comprised between 0.04 and 0.3 inclusive, where L13 is the length of a central part of the assembly screw comprising the guide portion.

4. The assembly screw as claimed in claim 1, wherein the threaded portion has an outside or nominal diameter less than or equal to 2 mm.

5. The assembly screw as claimed in claim 1, wherein the shoulder is positioned between the first zone of lower mechanical rigidity and the threaded portion.

6. The assembly screw as claimed in claim 1, wherein the first zone of lower mechanical rigidity has a hollow shape.

7. The assembly screw as claimed in claim 6, wherein the first zone of lower mechanical rigidity has a groove of constant or non-constant diameter.

8. The assembly screw as claimed in claim 1, wherein the shoulder has a truncated shape of an angle comprised between 10° and 60° inclusive.

9. The assembly screw as claimed in claim 8, wherein the shoulder has a truncated shape of an angle comprised between 20° and 45° inclusive.

10. The assembly screw as claimed in claim 1, wherein at least one selected from the group consisting of (i) the shoulder is positioned upstream of the threaded portion and (ii) the shoulder is positioned at the end of the guide surface.

11. The assembly screw as claimed in claim 1, wherein the screw comprises an initial part comprising the shoulder, the second zone of lower rigidity and the threaded portion, a central part comprising the guide surface and the first zone of lower rigidity, and a final part comprising a head for actuating the screw.

12. A bracelet, wherein the bracelet comprises at least two links assembled with pivoting via an assembly screw as claimed in claim 1.

13. The bracelet as claimed in claim 12, wherein the at least two links of the bracelet comprise a first link having an opening comprising a tapped hole in which the threaded portion of the assembly screw is arranged, and an abutment surface at the entrance to said opening and against which the shoulder of the assembly screw is positioned bearing thereagainst.

14. The bracelet as claimed in claim 12, wherein the at least two links of the bracelet comprise:

a first link comprising two edge link elements so that a head of the assembly screw is lodged within an opening in a first edge link element and so that a threaded portion of the assembly screw is lodged within an opening of the second edge link element, and a second link comprising an opening through which the assembly screw passes, so that the second link can pivot with a low amount of play about a guide surface of the assembly screw.

15. A timepiece, wherein the timepiece comprises at least two components assembled with pivoting by an assembly screw as claimed in claim 1.

16. The assembly screw as claimed in claim 1, wherein the ratio D10/D3 is comprised between 0.3 and 0.7 inclusive.

17. The assembly screw as claimed in claim 1, wherein the first zone of lower mechanical rigidity is arranged close to the threaded portion.

18. The assembly screw as claimed in claim 1, wherein a downstream end of the screw is positioned at a distance, measured from the downstream end of its shoulder, of less than or equal to the length L13/3, where L13 is the length of a central part of the assembly screw comprising the guide portion or in the half of the assembly screw that comprises the threaded portion.

19. The assembly screw of claim 1, wherein the second zone of lower mechanical rigidity is located in immediate vicinity upstream of the threaded portion.

20. A link assembly comprising a first link, a second link, and an assembly screw for the pivoting attachment of the first and second links, wherein the assembly screw comprises:

at least one guide portion allowing the first link to pivot, and at least one threaded portion allowing the first link to be fixed to the second link, a shoulder intended to come into abutment against the second link, the shoulder being located between the guide portion and the threaded portion, and a zone of lower mechanical rigidity to reduce the contact pressure applied at the shoulder of the assembly screw in the position of assembly of the two links, wherein the threaded portion of the assembly screw is screwed in a tapped hole of the second link, wherein the first link is rotatably guided on the guide portion of the assembly screw, and wherein the first zone of lower mechanical rigidity has a minimum cross section inscribed inside a circle of diameter D10 so that the ratio D10/D3 is comprised between 0.1 and 0.9 inclusive, where D3 is the diameter of the adjacent guide portion.

21. The link assembly of claim 20, wherein the shoulder is positioned between the first zone of lower mechanical rigidity and the threaded portion.

22. A bracelet comprising the link assembly according to claim 20.

23. An assembly comprising two horology components, and an assembly screw for the pivoting attachment of the two horology components, wherein the assembly screw comprises:

at least one guide portion allowing a first one of the horology components to pivot, and at least one threaded portion allowing the first one of the horology components to be fixed to a second one of the horology components, a shoulder intended to come into abutment against the second horology component, the shoulder being located between the guide portion and the threaded portion, and a zone of lower mechanical rigidity to reduce the contact pressure applied at the shoulder of the assembly screw in the position of assembly of the horology components, wherein the threaded portion of the assembly screw is screwed in a tapped hole of the second horology component, wherein the first horology component is rotatably guided on the guide portion of the assembly screw, and wherein the first zone of lower mechanical rigidity has a minimum cross section inscribed inside a circle of diameter D10 so that the ratio D10/D3 is comprised between 0.1 and 0.9 inclusive, where D3 is the diameter of the adjacent guide portion.

24. The assembly of claim 23, wherein the shoulder is positioned between the first zone of lower mechanical rigidity and the threaded portion.

* * * * *